United States Patent [19]

Eller

[11] 4,208,978

[45] Jun. 24, 1980

[54] LATERAL THRUSTER FOR A WATER VESSEL

[76] Inventor: James D. Eller, 33 NW. 2nd St., Deerfield Beach, Fla. 33441

[21] Appl. No.: 970,529

[22] Filed: Dec. 18, 1978

[51] Int. Cl.[2] ..... B63H 25/46

[52] U.S. Cl. ..... 114/151; 115/41 R; 415/149 R; 417/360

[58] Field of Search ..... 114/151, 147, 146, 148; 115/35, 41 R; 251/326; 417/360; 415/148, 149 R, 155, 159

[56] References Cited

U.S. PATENT DOCUMENTS

| | | | |
|---|---|---|---|
| 1,199,803 | 10/1916 | McDougall | 114/147 |
| 1,211,237 | 1/1917 | Rockwell | 251/326 X |
| 2,856,883 | 10/1958 | Baker | 115/41 R |
| 3,242,899 | 3/1966 | Hanson | 115/41 R |
| 3,907,463 | 9/1975 | Eller et al. | 417/360 |

*Primary Examiner*—Sherman D. Basinger
*Attorney, Agent, or Firm*—Oltman and Flynn

[57] ABSTRACT

The present bow thruster for water vessels comprises a submersible axial flow pumping unit mounted on the outside of the vessel at the bow to be raised to an inoperative position out of the water or lowered to an operative position in the water with its water-flow axis perpendicular to the longitudinal centerline of the vessel. The pumping unit is reversible, and it includes a hydraulic motor and a pump impeller inside an annular housing provided with gate valves at its opposite ends. The gate valve at the discharge end restricts the flow there to increase the thrust produced by the pump. A directional control and a fluid pressure source for the hydraulic motor in the submersible pumping unit are on board the vessel.

4 Claims, 12 Drawing Figures

FIG. 1
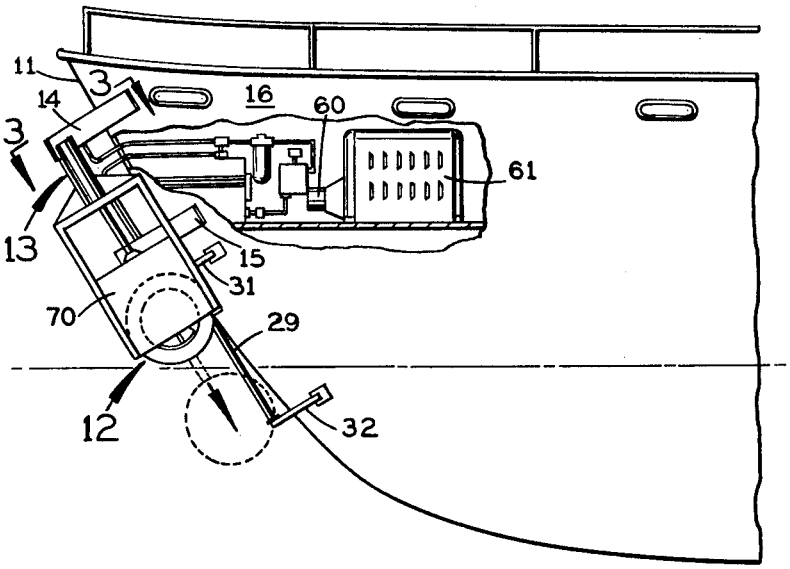
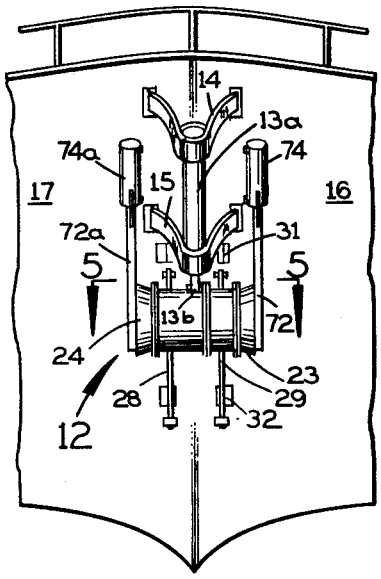
FIG. 2
FIG. 3
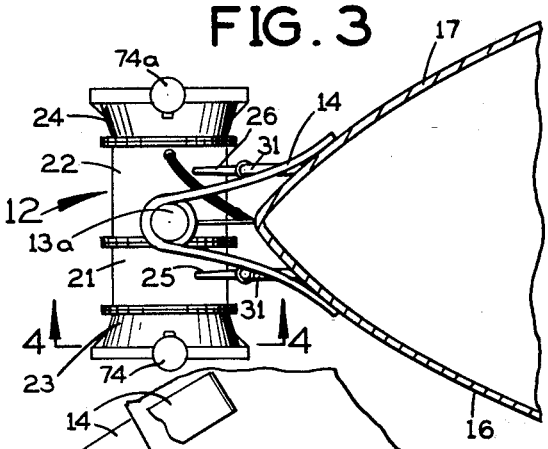
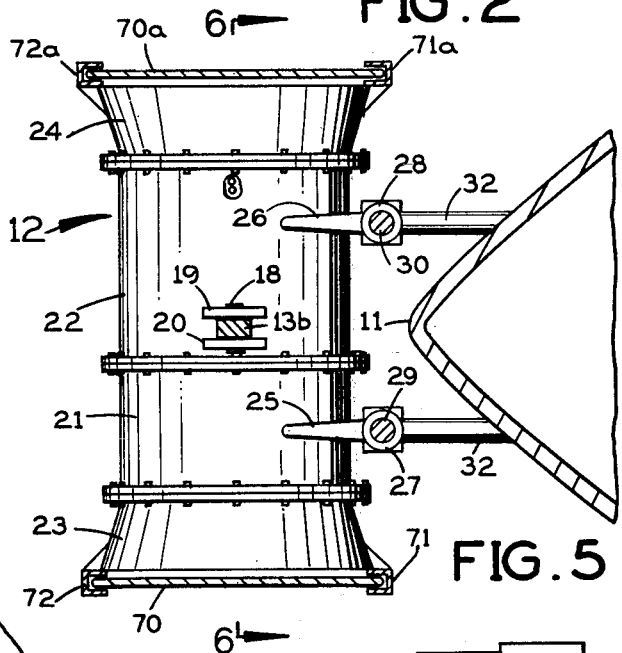
FIG. 5
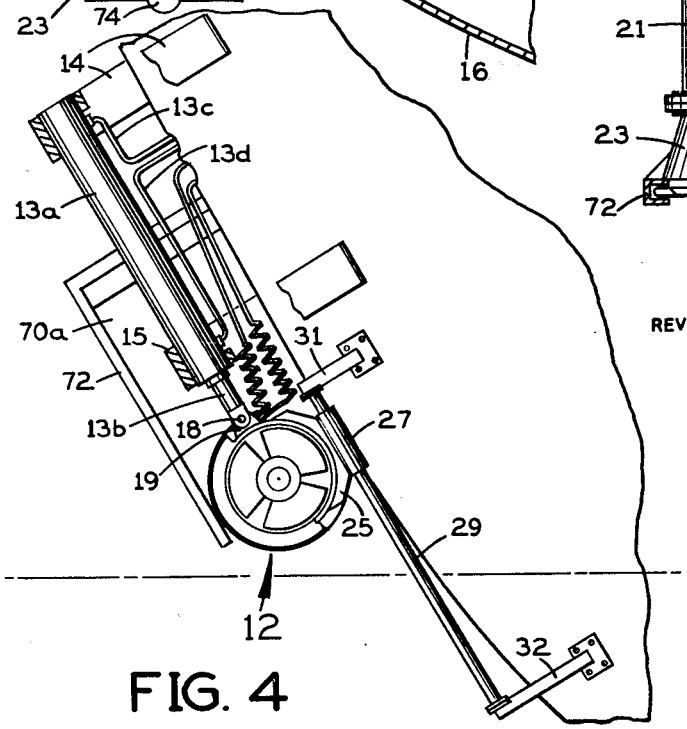
FIG. 4
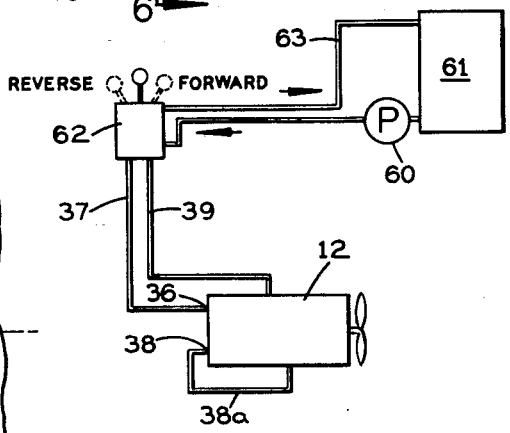
FIG. 12

LATERAL THRUSTER FOR A WATER VESSEL

SUMMARY OF THE INVENTION

This invention relates to a lateral thruster for a water vessel, such as a boat, barge or ship, and particularly to a bow thruster.

Maneuvering a water vessel toward or away from a dock can be greatly facilitated by providing on the vessel a thruster which can be operated selectively to produce a lateral thrust on the bow. Heretofore, bow thrusters typically were permanent, fixed-in-place installations, usually steel tunnels built into the hull of the vessel at considerable expense.

The present invention is directed to a novel lateral thruster for a vessel which may be attached to existing vessels which were constructed without this feature in mind. The present lateral thruster may be attached to such water vessels without expensive modification of the existing vessel and without affecting the integrity of the vessel's hull.

In accordance with the present invention, a lateral thruster for water vessels is provided which has a submersible pumping unit for producing the desired lateral thrust. Preferably, this submersible pumping unit comprises a rotary hydraulic motor driving an axial flow pump, with both the motor and the pump being mounted in an annular flow-through housing which can be lowered into the water or raised out of the water by a hydraulic cylinder-and-piston unit mounted on the exterior of the vessel's hull at the bow. A motor-driven or engine driven pump on board the vessel operates the hydraulic motor in the submersible pumping unit through flexible hoses extending between them. Preferably, the submersible pumping unit is reversible so that the lateral thrust it produces on the bow of the vessel may be in either direction. Preferably, also, the submersible pumping unit has separate valves at the water intake and discharge sides of its pump for selectively controlling the magnitude of the lateral thrust which it provides, as explained hereinafter.

The bow thruster is particularly useful in positioning offshore platforms such as those used for drilling or mining.

A principal object of this invention is to provide a novel and improved lateral thruster for a water vessel.

Another object of this invention is to provide such a thruster which may be added onto existing vessels with a minimum of structural modification of the vessel itself.

Another object of this invention is to provide a novel lateral thruster for a water vessel which embodies a submersible, axial flow pumping unit of known design and proven reliability.

Another object of this invention is to provide a novel lateral thruster having a submersible, axial flow pumping unit with valves at its opposite ends for adjusting the thrust which it exerts.

Another object of this invention is to provide a novel lateral thruster for a water vessel which is mounted on the exterior of vessel's hull at the bow and which may be selectively raised to an inoperative position out of the water and lowered to an operative position in the water.

Further objects and advantages of this invention will be apparent from the following detailed description of a presently-preferred embodiment thereof, which is shown in the accompanying drawings.

BRIEF DESCRIPTION OF DRAWINGS

FIG. 1 is a side elevational view of the bow of a boat provided with a lateral thruster in accordance with the present invention, with this thruster shown raised out of the water and the bow of the boat shown broken away for clarity;

FIG. 2 is a fragmentary end elevational view taken from in front of the boat;

FIG. 3 is a section taken along the line 3—3 in FIG. 1, looking down on the present bow thruster;

FIG. 4 is a sectional view of the present bow thruster taken along the line 4—4 in FIG. 3;

FIG. 5 is a section taken along the line 5—5 in FIG. 2;

FIG. 12 is a schematic block diagram of the hydraulic system for operating the present bow thruster.

Figure 6:
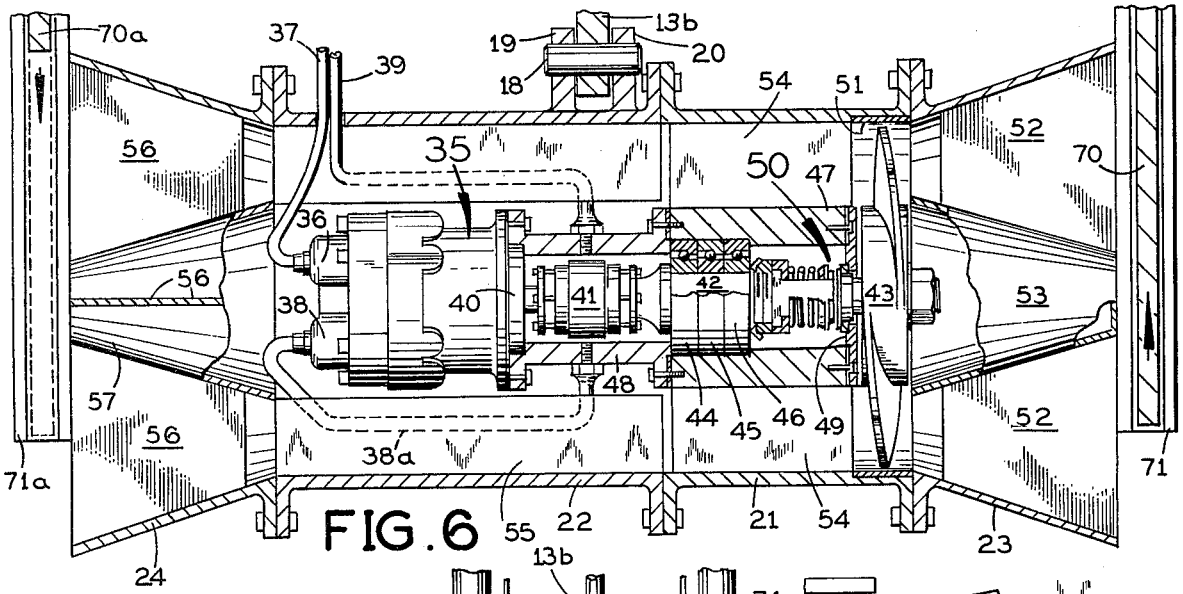
FIG. 6 is a longitudinal section through the submersible pumping unit in the present bow thruster.

Before explaining the disclosed embodiment of the present invention in detail, it is to be understood that the invention is not limited in its application to the details of the particular arrangement shown since the invention is capable of other embodiments. Also, the terminology used herein is for the purpose of described and not of limitation.

DETAILED DESCRIPTION

Referring to FIG. 1, the present bow thruster is mounted on the bow 11 of a boat. The bow thruster has a submersible pumping unit 12 which can be raised and lowered by a hydraulic cylinder-and-piston unit 13 mounted on the outside of the bow of the boat. FIG. 1 shows the submersible pumping unit 12 in full lines in a raised, inoperative position above the water line. The hydraulic cylinder-and-piston unit 13 may be actuated to lower the submersible pumping unit 12 to the phantom line position in FIG. 1 (the full line position in FIG. 7), in which it is below the water line and may be operated to exert a lateral thrust on the bow of the boat.

As best seen in FIG. 2, the cylinder **13*a* of the cylinder-and-piston unit 13 is rigidly supported at its upper and lower ends by generally U-shaped upper and lower brackets 14 and 15, which are welded or otherwise rigidly attached to the opposite sides 16 and 17 of the boat at the bow (FIG. 3) and to the outside of cylinder 13*a*. These brackets hold the cylinder 13 parallel to, and in front of the bow, so that the axis of the cylinder is inclined downward and rearward of the boat, as shown in FIG. 1**.

The piston (not shown) in the cylinder-and-piston unit 13 is attached to a piston rod **13*b* (FIG. 4) which extends down beyond the lower end of the cylinder 13*a***.

The lower end of this piston rod is connected through a cross pin 18 (FIGS. 4 and 5) to a pair of closely spaced, parallel plates 19 and 20 affixed to the top of the housing of the submersible pumping unit 12.

A pair of pipes or hoses 13*c* and 13*d* (FIG. 4) are connected to the opposite ends of the hydraulic cylinder 13*a*. These pipes or hoses are connected to a suitable pressurized hydraulic fluid supply source on board the vessel, such as a pump and a fluid reservoir, through a directional valve (not shown) in a conventional manner well known in the hydraulic systems art. This valve may be operated manually to either (1) supply pressurized hydraulic fluid through pipe 13*d* to the lower end of cylinder 13*a* and relieve the hydraulic pressure in the upper end of this cylinder through pipe 13*c*, so that the piston will be raised in the cylinder or (2) supply pressurized hydraulic fluid through pipe 13*c* to the upper end of cylinder 13*a* and relieve the hydraulic pressure in the lower end of this cylinder through pipe 13*d*, so that the piston will be lowered in the cylinder.

The housing of the submersible pumping unit 12 is of four-piece construction (FIGS. 2 and 3) comprising adjoining, cylindrical sections 21 and 22 and axially shorter, outwardly flared, frusto-conical end pieces 23 and 24. The neighboring sections have annular transverse, outwardly projecting flanges which abut against each other and are bolted together in watertight fashion.

A pair of similar convex yokes 25 and 26 (FIGS. 4 and 5) are rigidly fastened to the outside of the housing sections 21 and 22, respectively. These yokes are integrally connected to respective cylindrical sleeves 27 and 28. The sleeves are slidable along respective rigid guide rods 29 and 30 which extend parallel to, and on opposite sides of, the axis of the cylinder 13*a*. Each of the guide rods is rigidly supported by respective upper and lower brackets 31 and 32 affixed to the adjacent side 16 or 17 of the boat. The rods 29 and 30 guide the up-and-down movement of the submersible pumping unit 12.

Referring to FIG. 6, the submersible pumping unit 12 includes a rotary hydraulic motor 35 of known design which is supported centrally inside the housing section 22. The hydraulic motor 35 has a rotary output shaft 40 which is connected through a coupling 41 and connecting shaft 42 of known design to the rotary impeller 43 of the pump. The connecting shaft 42 is rotatably supported by three ball bearings 44, 45 and 46, as described in U.S. Pat. No. 3,907,463. These bearings are positioned end-to-end in a cylindrical housing 47 mounted concentrically inside the housing section 21 of the submersible pumping unit. The shaft coupling 41 is located inside a flanged cylindrical housing 48 whose left end in FIG. 6 is bolted to the housing of the hydraulic motor 35 and whose right end is bolted to the housing 47 in fluid-tight fashion.

The hydraulic motor 35 has a first port 36, which may be either an inlet or outlet port, and a second port 37, which may be either an outlet or inlet port. The first port 36 is connected to the lower end of a first flexible hose 37. The lower end of a second flexible hose 39 is fastened to the housing 48 and is in fluid communication with the interior of this housing. A bypass pipe 38*a* extends from the second motor port 38 to the housing 48 and is in fluid communication with the interior of housing 48.

For rotating the pump impeller 43 in a first direction, the first port 36 of the hydraulic motor 35 is its inlet port and the second port 38 is its outlet port. Pressurized hydraulic liquid flows down through the first hose 37 to the first port 36, and from this port through the interior of the hydraulic motor to the second port 38, and from here via the bypass pipe 38*a* through the interior of the housing 48 before passing up into the second hose 39.

Conversely, for rotating the pump impeller 43 in the opposite direction, the second port 38 of the hydraulic motor is its inlet port and the first port 36 is its outlet port. Pressurized hydraulic liquid flows down through the second hose 39, and via the interior of the housing 48 and the bypass pipe 38*a* to the second motor port 38, and from there through the interior of the hydraulic motor 35 to its first port 36, and from there up through the first hose 37.

In either direction of operation of the hydraulic motor 35 the coupling 41 is lubricated by the hydraulic liquid circulating through the interior of the housing 48.

The connecting shaft 42 extends through a central opening in a flat, annular, transverse end plate 49 bolted to the right end of housing 47 in FIG. 6. A liquid-tight seal 50 of known design prevents leakage around the connecting shaft 42 where it passes through the end plate 49.

The pump impeller 43 is located inside the right end of the housing section 21 in FIG. 6. This housing section carries a cylindrical liner 51 with which the curved blades of the impeller 43 have a close running fit.

The flared end piece 23 of the housing of the submersible pump unit carries a plurality of circumferentially spaced, radially disposed, flat plates 52 on the inside and a frustoconical nose 53 centered between these plates. Preferably, each plate 52 is welded to the outside of the nose 53 and is welded to the inside of the housing end piece 23.

Inside the housing section 21 to the left of the pump impeller 43 in FIG. 6, a plurality of circumferentially spaced, radially disposed, flat plates 54 have their outer edges welded to the inside of the housing section 21 and their inner edges welded to the outside of the housing 47 for the connecting shaft.

The next section 22 of the housing of the submersible pump unit has a plurality of circumferentially spaced, flat plates 55 extending radially inward into close proximity to the casing of the hydraulic motor 35 and the housing 48 for the shaft coupling 41. These plates are welded to the inside of the housing section 22.

The end piece 24 of the housing of the submersible pumping unit is a mirror image of the opposite end piece 23. It carries a plurality of circumferentially spaced, radially disposed, flat plates 56 and a frusto-conical nose 57 centered between them.

In either direction of rotation of the rotor of the hydraulic motor 35 and the pump impeller 43, the radial plates 52, 54, 55 and 56 serve to channel the inlet and outlet flows of water into and out of the pump into separate, substantially axial streams through the interior of the housing of the submersible pumping unit. These separate axial streams merge with each other at the discharge side of the submersible pumping unit.

FIG. 12 illustrates schematically the hydraulic control system for the submersible pumping unit 12. A motor-driven or engine-driven pump 60 on board the boat draws hydraulic liquid from a reservoir 61, also on the boat as shown in FIG. 1. The output side of the pump 60 is connected to the inlet of a manually-operated directional valve 62 on board the boat. Valve 62 has a pair of outlet/return ports connected respectively to the upper ends of the aforementioned hoses 37 and 39, which lead down to the hydraulic motor 35 (FIG. 6) in the submersible pumping unit 12.

In one setting of the directional valve 62, it connects the output of the on-board pump 60 to hose 37 and it connects the other hose 39 to a return line 63 going back to the on-board reservoir or sump 61. In the opposite setting of the directional valve 62, it connects the output of the on-board pump 60 to hose 39 and it connects hose 37 to the return line 63. Therefore, the setting of the directional valve 62 on board the boat determines the direction in which the impeller 43 (FIG. 6) in the submersible pumping unit is driven. The directional valve 62 also has a neutral setting, of course, in which it simply recirculates the output from the on-board pump 60 back to the reservoir 61 and blocks the output of pump 60 from both hoses 37 and 39.

In accordance with an important aspect of the present invention, the submersible pumping unit 12 is provided with valves at its opposite ends for regulating the flow of water into its inlet end and the discharge of water from its outlet end. Preferably, as shown in the drawings, these valves are gate valves, with the inlet valve adjusted to a position permitting substantially unrestricted flow of water into the inlet end of the housing of the submersible pumping unit and the outlet valve adjusted to a position substantially restricting the discharge of water from its outlet end. With this arrangement, the inlet flow velocity may be about 2 to 3 feet per second and the outlet flow velocity may be 10 to 12 feet per second, a substantial increase.

Figure 8:
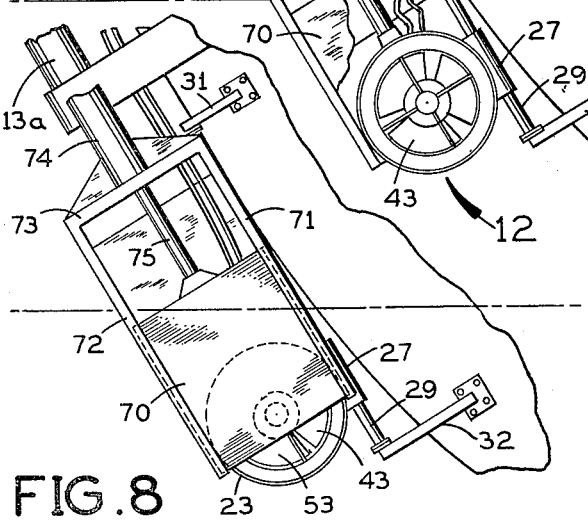
FIG. 8 is an elevational view of the present bow thruster taken from the water discharge side of its submersible pumping unit.

As shown in FIG. 8, a valve member in the form of a flat plate 70 is slidably reciprocable at the right end of the submersible pumping unit 12. This plate is slidably supported by a guide framework having a downwardly and rearwardly inclined rear leg 71, a parallel front leg 72, and a top piece 73 rigidly interconnecting them. As shown in FIG. 5, each of the downwardly and rearwardly inclined legs 71 and 72 is channel-shaped in cross-section for guiding the plate 70 slidably.

A hydraulic cylinder 74 extends up from the top piece 73 of the guide framework. A piston (not shown) is slidable along the inside of this cylinder and is attached to a downwardly and rearwardly inclined piston rod 75, whose lower end is connected to the top of the plate 70. The upper and lower ends of the hydraulic cylinder 74 are connected through respective hoses (not shown) to a directional valve on board the vessel in the same manner as the cylinder **13*a* for raising and lowering the submersible pumping unit 12. This directional valve may be operated manually to control the supply of hydraulic liquid under pressure to either end of the cylinder 74** and the exhaust of hydraulic liquid from the opposite end of this cylinder.

The guide framework 71–73 may carry a limit stop (not shown) at its lower end which is engageable by the bottom edge of the valve plate 70 to limit its downward movement, so that when the valve plate 70 is fully lowered it does not completely obstruct the adjacent end mouth of the housing section 23 of the submersible pumping unit 12.

An upper limit stop (also not shown) may be provided on the guide framework for engagement by the top edge of the valve plate 70 to limit the latter's upward movement. When the valve plate 70 engages the upper limit stop, it completely uncovers the adjacent end mouth of the housing section 23 of the submersible pumping unit.

The valve arrangement at the opposite end of the submersible pumping unit 12 is of the same construction, and corresponding elements of this valve arrangement are given the same reference numerals, with an "a" suffix added, as the valve arrangement 70–73 and need not be described in detail.

Figure 9:
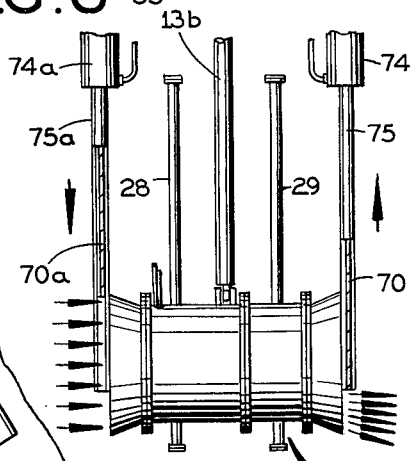
FIG. 9 is an elevational view of the submersible pumping unit with its inlet substantially unrestricted and its outlet restricted to increase the thrust it exerts.

As shown in FIGS. 6 and 9, when water is to be drawn into the submersible pumping unit 12 at the left end and discharged at the right end, the valve plate **70*a* at the inlet end is raised fully and the valve plate 70 at the discharge end is lowered. This provides a much smaller discharge passageway at the right end tha the unobstructed inlet passageway at the left end of the submersible pumping unit 12**. Consequently, the water is discharged by the pump at a velocity which is several times the velocity at which it flows into the submersible pumping unit. Thus, the lateral thrust produced by this pumping unit is substantially enhanced.

Preferably, the inlet valve at one end of the submersible pumping unit 12 will be fully open and the valve at the opposite end will be lowered to the lower limit stop to provide the maximum velocity differential between the inlet and discharge flows. However, if desired, either valve may be adjusted to an intermediate position in which it does not engage either the upper limit stop or the lower limit stop.

OPERATION

Normally, when the boat is not in the vicinity of the dock, the hydraulic cylinder **13*a* will be actuated to hold the submersible pumping unit 12 in an inoperative position, raised out of the water, as shown in FIG. 1**, so as not to produce a drag tending to impede the vessel's movement through the water.

Figure 7:
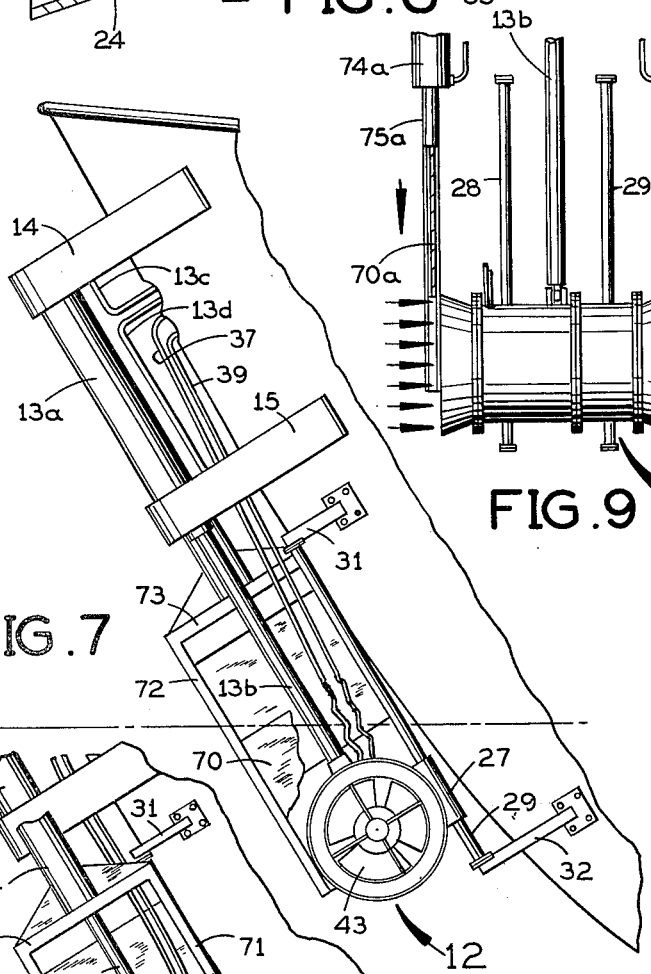
FIG. 7 is a view similar to FIG. 1, but with the submersible pumping unit lowered to an operative position in the water.

When docking maneuvers are required, the cylinder **13*a* is actuated to extend the piston rod 13*b* and lower the submersible pumping unit 12 to an operative position in the water, as shown in FIG. 7 and in phantom in FIG. 1. The axis of the submersible pumping unit 12 is perpendicular to the longitudinal centerline of the boat. Depending upon the direction of lateral thrust that is desired, the gate valve at one end of the pumping unit 12** is opened and the gate valve at the opposite end is moved down to partially close that end of the pumping unit to the desired extent.

Figure 10:
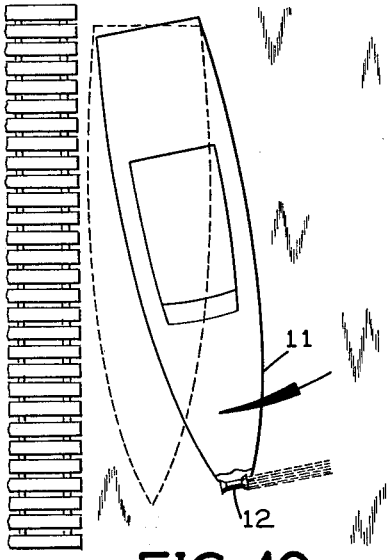
FIG. 10 is a top plan view of water vessel provided with the present bow thruster operating to move the bow clockwise from the full-line position away from the dock to the phantom-line position next to the dock.

As shown in FIG. 10 (looking forward), if the boat is on the left side of the dock and the bow is farther away from the dock than the stern of the boat, the directional valve 62 on board the boat is set to cause the submersible pumping unit 12 to draw in water at its right end and discharge it at its left end, thereby producing a lateral thrust on the bow of the boat to move it toward the dock to the phantom line position in FIG. 10.

Figure 11:
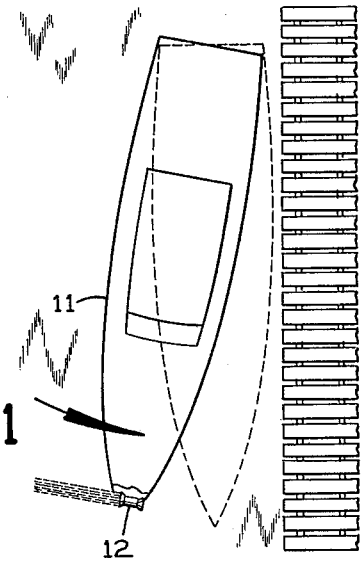
FIG. 11 is a view similar to FIG. 8 but with the bow being displaced in the opposite direction.

Alternatively, as shown in FIG. 11, if the boat is being docked at the right side of the dock (looking forward at the boat) and the bow is away from the dock, the directional valve 62 is set to cause the submersible pumping unit 12 to draw in water at its left end and discharge it at its right end, thereby producing a lateral thrust on the bow of the boat to move it to the left toward the dock (from the full line position to the phantom line position in FIG. 110.

If desired, a unitary hydraulic control arrangement or interlock (not shown) may be provided among the directional valve 62 for the submersible pumping unit 12 and the cylinders 74 and **74*a* which operate the gate valves 70 and 70*a* at the opposite ends of this pumping unit, so that the gate valve at what has been selected by valve 62 as the inlet end of the pumping unit 12** will be wide open and the gate valve at the opposite end will be closed to the extent desired.

It is to be understood that one or more of the various hydraulic cylinder-and-piston units in the described embodiment of the present apparatus may be replaced by a pneumatic cylinder-and-piston unit or an electric motor-driven mechanism or a mechanically actuated mechanism for performing the same function. Also, in the submersible pumping unit the hydraulic motor may be replaced by a sealed electric motor, if desired.

I claim:

1. A lateral thruster on a water vessel having a separate propulsion unit comprising:

a submersible pumping unit including an axial flow pump, a hydraulic motor driving said pump, and a unitary housing surrounding said pump and motor, said housing being open at its opposite axial ends and providing flow passage means outside said motor for passing water taken in at one of its axial ends and discharged at its opposite axial end by the pumping action of said pump driven by the motor;

support means for reciprocably mounting said submersible pumping unit on the outside of the vessel in a position to exert a lateral thrust on the vessel by said pumping action;

a source of pressurized hydraulic fluid on the vessel;

hydraulic lines operatively connecting said source to said hydraulic motor for operating the latter;

said support means including a cylinder rigidly mounted on the bow of the vessel by bracket means and extending downward therefrom toward the water;

a piston reciprocable in said cylinder and having a piston rod extending downward from the cylinder and operatively connected to the housing of the submersible pumping unit;

fluid pressure control means hydraulically coupled to said cylinder and said source for raising and lowering said piston in the cylinder to raise and lower the submersible pumping unit into and out of the water;

a pair of rigid rods extending downward along the outside of the vessel; and guide sleeves attached to said housing of the submersible pumping unit and slidably mounted respectively on said rods for movement up and down along said rods.

2. A lateral thruster according to claim 1, and further comprising respective valves controlling the flow of water into and out of said submersible pumping unit, and means for selectively adjusting said valves to provide a more restricted flow of water at the discharge end of said pumping unit than at its inlet end.

3. A lateral thruster according to claim 2, wherein each of said valves is a gate valve slidably adjustable at the corresponding end of said housing of the submersible pumping unit.

4. A lateral thruster according to claim 1, wherein said hydraulic motor and said pump in the submersible pumping unit are reversible selectively to determine the direction of the lateral thrust.

* * * * *